US006446365B1

(12) United States Patent
Sullivan et al.

(10) Patent No.: US 6,446,365 B1
(45) Date of Patent: Sep. 10, 2002

(54) NOZZLE MOUNT FOR SOFT EXCAVATION

(75) Inventors: Dennis J. Sullivan; Ryan Douglas King, both of Pella; Scott Alan Johnson, Oskaloosa, all of IA (US)

(73) Assignee: Vermeer Manufacturing Company, Pella, IA (US)

( * ) Notice: Subject to any disclaimer, the term of this patent is extended or adjusted under 35 U.S.C. 154(b) by 33 days.

(21) Appl. No.: 09/662,185

(22) Filed: Sep. 15, 2000

(51) Int. Cl.[7] ..... E02F 1/00
(52) U.S. Cl. ..... 37/195; 37/905
(58) Field of Search ..... 37/195, 905, 347, 37/317, 323, 335, 336, 344, 466; 299/17

(56) References Cited

U.S. PATENT DOCUMENTS

| | | | | |
|---|---|---|---|---|
| 168,278 | A | | 9/1875 | Newton |
| 223,479 | A | | 1/1880 | Case |
| 552,285 | A | | 12/1895 | Gwynne |
| 1,994,884 | A | | 3/1935 | Chew |
| 2,018,285 | A | | 10/1935 | Schweitzer et al. |
| 2,678,203 | A | | 5/1954 | Huff |
| 2,774,569 | A | | 12/1956 | Jacobsen |
| 3,585,740 | A | | 6/1971 | Koning |
| RE27,316 | E | | 3/1972 | Elenburg |
| 5,016,717 | A | * | 5/1991 | Simons et al. ..... 175/66 |
| 5,284,215 | A | | 2/1994 | Tibbitts |
| 5,291,957 | A | | 3/1994 | Curlett |
| 5,361,855 | A | * | 11/1994 | Schuermann et al. ..... 175/67 |
| 5,408,766 | A | * | 4/1995 | Pobihushchy ..... 37/905 X |
| 5,887,667 | A | | 3/1999 | Van Zante et al. |
| 6,000,151 | A | * | 12/1999 | Hayes ..... 37/323 |
| 6,202,330 | B1 | * | 3/2001 | Bolton ..... 37/403 |
| 6,273,512 | B1 | * | 8/2001 | Rajewski ..... 299/17 |

FOREIGN PATENT DOCUMENTS

| | | |
|---|---|---|
| GE | 1 484 730 | 6/1969 |
| GE | 1 963 720 | 7/1970 |
| IT | 696876 | 10/1965 |
| JP | 4-327687 A | 11/1992 |

OTHER PUBLICATIONS

"E550 & E800 Evacuator™ Vacuum Systems", Vermeer (2–page flyer, circa Sep. 27, 1999).
"E550 Vacuum Excavation System", Vermeer (2–page flyer, circa Sep. 27, 1999).
"Jet–Vacs", Ring–O–Matic Manufacturing co., Inc., http://www.ringo–matic.com/jetvc.htm, updated Oct. 09, 2000, pp. 1–2.
"Potholing for excavation damage prevention", Vacuum Source Inc., http://vacsource.com/potholing.htm, updated Apr. 30, 2000, pp. 1–2

* cited by examiner

*Primary Examiner*—Victor Batson
(74) *Attorney, Agent, or Firm*—Merchant & Gould P.C.

(57) ABSTRACT

A nozzle mount assembly for use in soft excavation. The assembly includes a vacuum tube, nozzle ports, and a wear ring. The vacuum tube defines air flow passages including an open lower end of the vacuum tube and air relief slots located near its lower end. The nozzle ports are defined by a manifold having air troughs located between the nozzle ports. Each nozzle port is configured to receive a high-pressure fluid nozzle. One nozzle port is angled toward the center of the vacuum tube, and two nozzle ports are angled away from the vacuum tube. The nozzle port angled toward the center of the vacuum tube is configured to direct a fluid stream through an air relief slot in the vacuum tube.

21 Claims, 3 Drawing Sheets

NOZZLE MOUNT FOR SOFT EXCAVATION

The present invention relates to excavation devices. Specifically, the present invention relates to a nozzle mount for a hydraulic excavation device for use in soft drilling applications.

BACKGROUND OF THE INVENTION

Existing buried gas, electric, water, telephone, and sewer utility lines are in constant need of repair and replacement. Laying new service lines in areas where existing lines are already buried is complicated by the risk of damaging existing lines during excavation.

For instance, when excavation work must be done in a right-of-way containing a fiber optic cable, it is often desirable to accurately determine the location of the fiber optic cable so that the excavator can avoid damaging it. However, the exact location of a cable buried between manholes can be difficult to determine. Earth movement and settling may have shifted the cable from its original location and render it difficult to locate. Furthermore, the absence of ferrous metals and current-carrying conductive wires from a fiber optic cable can preclude or at least minimize the suitability of magnetic and current-detecting devices. Thus, locating buried fiber optic cables often requires physically exposing them. In this manner their locations can be determined with relative precision. Between the manholes the cable right-of-way is typically "potholed" by excavating at predetermined intervals to expose the buried cable. If only the cable location is desired, a large opening is generally unnecessary. Potholing may be accomplished with hand tools, machines, or both. However, since hand tools are relatively slow and equipment use is attended by a risk of cable damage, both methods have their drawbacks.

The use of mechanical excavation devices such as backhoes, augers, or even shovels threaten to damage undetected buried lines. "Soft" excavation devices use liquid or pneumatic cutting actions in order to prevent damage to underground lines. Devices known in the field are shown in U.S. Pat. Nos. 5,887,667 and 5,860,232. These references disclose an alternative method of excavating each of which has advantages and disadvantages. Typically, these types of excavation, as compared to more conventional methods of mechanical excavation, require higher energy use per volume of material excavated, and may be slower than the conventional excavation. Some devices such as the device shown in U.S. Pat. No. 5,291,957 to Curlett include fluid excavation with mechanical drilling. To the extent that they rely on mechanical means for cutting, grinding or breaking up the soil, such devices still threaten to damage buried objects. There is significant need for improved soft excavation devices that will not damage existing underground lines during use.

SUMMARY OF THE INVENTION

One aspect of the present invention is directed to a nozzle mount assembly for use in soft drilling employing liquid jet nozzles. The assembly includes a straight vacuum tube of electrically nonconductive material, having proximal and distal ends, and a plurality of nozzle ports disposed around the vacuum tube. The vacuum tube defines an air relief slot near its distal end.

Another aspect of the present invention relates to a wear ring disposed on the distal end of the vacuum tube.

A further aspect of the present invention relates to angling the nozzle ports such that at least one nozzle port is angled toward the inside of the vacuum tube and at least one nozzle port is angled away from the vacuum tube.

Another aspect of the present invention relates to configuring a nozzle port to be angled to direct fluid through the air relief slot.

Yet another aspect of the present invention relates to a manifold for use with a vacuum tube in soft excavation. The manifold is configured to be disposed around the vacuum tube. The manifold includes a plurality of nozzle ports, at least one of which is inwardly angled and at least one of which is outwardly angled. The manifold further defines an air trough separating two of the nozzle ports.

DETAILED DESCRIPTION OF THE PREFERRED EMBODIMENT

Figure 3:
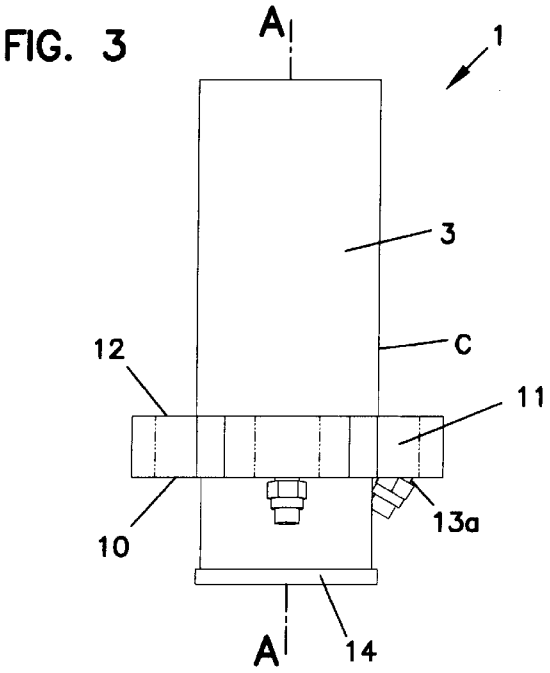
FIG. 3 shows a top view of the nozzle mount assembly of FIG. 1.
Figure 4:
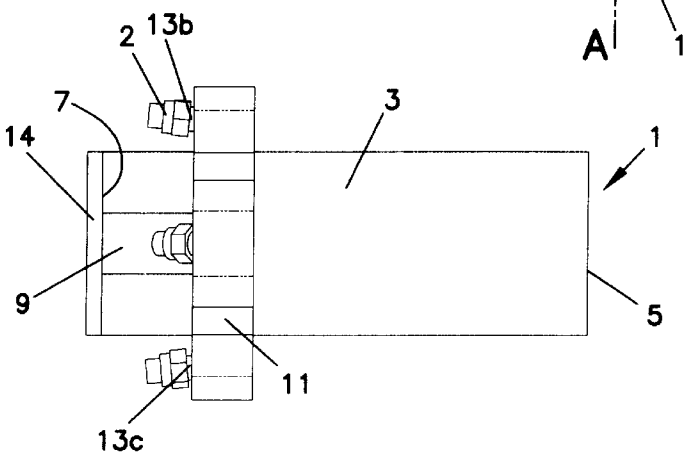
FIG. 4 shows a side view of the nozzle mount assembly of FIG. 1.
Figure 1:
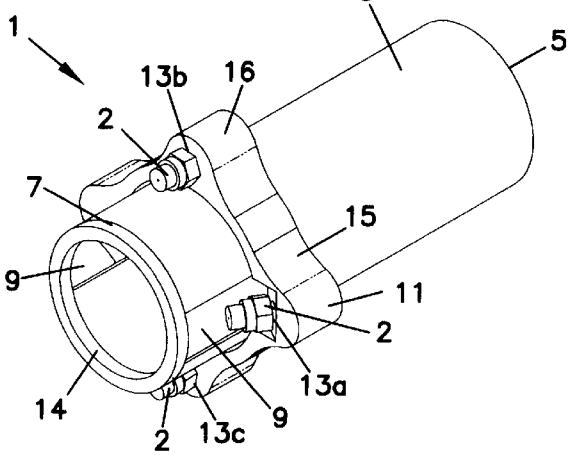
FIG. 1 shows a perspective view of a nozzle mount assembly according to the present invention.
Figure 2:
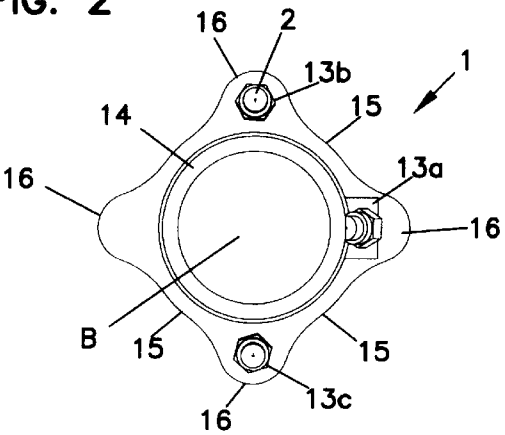
FIG. 2 shows a distal end view of the nozzle mount assembly of FIG. 1.

Referring now to the several drawing figures in which identical elements are numbered identically, a nozzle mount assembly 1 according to the present invention is shown. The nozzle mount assembly is meant to be coupled to both a fluid pressure system and a vacuum system. The fluid pressure system conveys water or other fluid under pressure to the nozzle mount assembly 1. Nozzles 2 mounted in the nozzle mount assembly 1 then direct the pressurized fluid into soil-cutting streams. The system pressure and nozzles are sized to produce a soil-cutting stream that is efficient at cutting and dislodging soils, yet not aggressive enough to damage utilities. The streams of fluid cut away and or dislodge the soil, clay, and rocks while the vacuum system evacuates the fluid mixed with soil debris, clay and rocks away from the hole being excavated. The assembly 1 may be included as part of an excavator wand to be held and manually operated by a single worker, or, alternatively the assembly 1 may be incorporated into a larger excavation vehicle having a hydraulically operated excavation arm onto which the assembly 1 may be mounted.

The nozzle mount assembly 1 includes a vacuum tube 3 and a blunt wear ring 14. The vacuum tube 3 has a proximal end 5 and a distal end 7. The proximal end 5 of the vacuum tube 3 may configured to be coupled to a vacuum wand which couples the vacuum tube 3 to the vacuum system. The vacuum tube 3 is characterized by an interior B, an exterior C, and a center axis (line A—A). The vacuum wand to which the vacuum tube is coupled may comprise a nonconductive shaft such as a PVC pipe in order to resist electrical conductance through the tube if a power line is struck by the assembly 1. Rather than as a funnel, the vacuum tube 3 is preferably shaped as a straight section of pipe (i.e. the pipe has a constant inner diameter) to prevent plugging associated with contraction of the vacuum tube's inner diameter.

The nozzles 2 are mounted near the distal end of the vacuum tube 3. One embodiment includes a manifold 11 that is disposed around the exterior of the vacuum tube 3. The manifold 11 can be connected to the tube by any number of techniques such as welding, press-fit, etc. The manifold 11 is "star-shaped," defining a plurality of radially-extending, rounded nozzle port regions 16 or protuberances spaced around an outer perimeter of the manifold. The nozzle port regions define angled nozzle ports 13*a*, 13*b* and 13*c* which are configured with threadings to accept standard high pressure nozzles 2, such as No. 3.5 sized nozzles. As is known in the art, "No. 3.5 nozzles" refers to the flow through the nozzle at a given fluid pressure. A No. 3.5 nozzle has an aperture having a diameter of approximately 0.044 inches. At 40 psi of water pressure,0.35 gallons per minute will flow through a No. 3.5 nozzle. Such nozzles may be obtained from Spraying Systems Co. in Wheaton, Ill. The nozzle port regions 16 of the manifold 11 protect the nozzles 2 from scraping against the side of the excavated hole.

The nozzles 2 are received into the nozzle ports 13*a–c* from a distal side 10 of the manifold 11. Each nozzle port 13*a–c* receives a fluid hose or tubing from a proximal side 12 of the manifold 11. Therefore, the nozzle ports 13*a–c* couple fluid hoses or other tubing to each nozzle 2. In the preferred embodiment shown in the figures, nozzle ports 13*a–c* allow the use of three individual lengths of hose. By separating the fluid flow into individual streams carried in individual hoses, the flow of fluid to the nozzles 2 preferably is kept as laminar as possible. This streamline effect produces a concentrated spray from each nozzle 2 which is optimal for soil cutting. Also, placing the nozzle ports 13*a–c* and nozzles 2 around the outside of the vacuum tube 3, instead of inside the vacuum tube 3, minimizes soil collection around the nozzles during the vacuuming process.

Nozzle port 13*a* is inwardly angled relative to the central axis A—A so that the stream of fluid exiting the nozzle mounted therein will be directed toward the interior of the vacuum tube 3 and will carve away the soil adjacent the distal end 7 of the vacuum tube 3. In certain embodiments, the port 13*a* is angled 10 to 70 degrees relative to the central axis A—A of the tube 3. In the preferred embodiment shown in the figures, nozzle port 13*a* is angled 30 degrees toward the center axis of the vacuum tube away from a direction parallel to the center axis.

Nozzle ports 13*b* and 13*c* are each outwardly angled relative to the central axis A—A so that the stream of fluid exiting the nozzles 2 mounted therein will be directed away from the vacuum tube 3 toward the sidewall of the hole being excavated. Thus, upon rotation of the tube 3 about its center axis A—A by the operator, the stream from the outwardly angled nozzle cuts a hole in the soil that is bigger than the diameter of the vacuum tube 3. In certain embodiments, the nozzle ports 13*b* and 13*c* are angled up to 40 degrees relative to the central axis A—A of the tube 3. The angle of the nozzles, and their effective cutting characteristics, as influenced by the geometry of the nozzles 2 and the fluid pressure and flow, combined with the type of soil being cut will determine the diameter of the hole being excavated. In a preferred embodiment, the nozzle ports 13*b* and 13*c* are angled 5 degrees relative to the central axis A—A. By so directing the fluid streams, a hole will be excavated which is larger in diameter than the nozzle mount assembly 1. Carving a hole larger in diameter than the excavation assembly 1 allows for the assembly 1 to be easily rotated as the assembly 1 digs down. In addition, the larger excavation hole permits air to reach the distal end of the assembly 1.

During operation, the assembly 1 is rotated so that a fluid stream is directed against all sides of the hole being excavated. This may be accomplished by rotating the assembly 1 back and forth approximately 180 degrees or by continuously rotating the assembly 1 in the same direction.

Preferably, 0° spray pattern nozzles 2 are used to provide optimum cutting action. In the preferred embodiment shown in the figures, No. 3.5 orifice nozzles are used at water pressures around 750 psi. This provides for suitable soil cutting capability without damaging underground utilities, cables, or other buried items. The No. 3.5 orifice nozzles are also large enough for adequate self-cleaning and reduced nozzle plugging. The manifold 11 may be positioned a distance away from the distal end of the assembly (e.g. 1 to 5 inches ) to protect the nozzles from abrasive wear and to protect buried lines from unnecessary contact with the fluid streams. The manifold 11 of the present invention permits the use of fixed place nozzles which are less expensive and require less maintenance than rotary type nozzles. The size of the nozzle orifices may be varied so long as the flow rate of fluid through the orifices is appropriately adjusted to prevent damage to buried utilities and lines.

On the distal end 7 of the vacuum tube 3 is disposed a blunt wear ring 14. The wear ring 14 provides a blunt edge to prevent any mechanical cutting action so that buried cables or other lines are not damaged as the assembly 1 digs down. In addition, the wear ring 14 may also give the assembly 1 a smaller diameter at the its most distal end so that the assembly 1 produces higher pick-up velocity and suction power. The wear ring 14 also reduces wear on the distal end 7 of the vacuum tube 3 due to abrasion from rocks and soil. The wear ring 14 provides a blunt end to the assembly, being at least 1.5 times and preferably more than 2 times greater in thickness than the wall of the vacuum tube 3.

The distal end of the vacuum tube 3 is designed to optimize the excavating action of the air flow that results from the vacuum applied to the vacuum tube during excavation. Preferably, there are various air flow paths provided, each with a different effect on the excavating characteristics of the assembly. At a minimum, there is a flow path defined by the open end of the vacuum tube 3. Additionally, there is preferably a secondary flow path that is large enough to allow a significant air flow rate in the event the end of the vacuum tube 3 is blocked off. In a preferred embodiment, this secondary air flow path is defined by two air relief slots 9 that extend longitudinally along the length of the vacuum tube 3 from its distal end 7 to the manifold 11. The wear ring 14 defines the bottom edge of the slots 9. In one non-limiting embodiment, each of the slots has a width of at least ½inch to inhibit plugging of the slots.

The wear ring 14 in cooperation with the relief slots 9 may also give the assembly 1 a smaller diameter at its most distal end so that the assembly 1 produces higher pick-up velocity and suction power. This occurs when the assembly 1 is set on the soil such that the wear ring 14 seals off the end of the tube 3. In that occurrence 100% of the air flow is through the air relief slots 9. In prior art devices, any small change in clearance between the soil and the distal end of the vacuum tube has a significant effect on the resulting air velocity. The addition of air relief slots 9, however, provides for more consistent air velocity. Additionally, in prior art devices, the air flow occurs around the complete circumference of the vacuum tube. An advantage of this invention is that the cooperation of the wear ring 14 and the air relief slots 9 results in a controlled flow of air producing multiple more effective excavation points, defined by the air relief slots 9.

In certain embodiments, at least one air relief slot 9 is aligned with nozzle port 13*a* so that its corresponding nozzle 2 is adapted to direct fluid inwardly through the slot 9 to excavate material directly beneath the distal end 7 of the tube 3. Air allowed into the vacuum tube 3, through the air relief slots 9, assists in carrying particles of soil that were excavated directly below the distal end of the tube 3 up the length of the assembly 1. Additionally when the operator raises the assembly 1 such that the wear ring 14 is not resting on the soil, air will flow around the circumference of the wear ring 14 and more aggressively transport this same material.

The soil that is being excavated from the annular space 20 defined by the outer diameter of the tube 3 and the effective cutting radius of nozzles 2 mounted in ports 13*b* & 13*c* is transported by the air flow around the circumference of the wear ring 14 and/or through the air relief slots 9.

The volume of soil being excavated from directly below the distal end 7 of the tube 3 may be equal to or slightly less than the volume of soil being excavated from the annular space 20. The volume of material being excavated is directly proportional to the cross sectional areas of the spaces. The cross sectional areas are directly proportional to the square of the diameters. As a result, the effectiveness of the excavating mechanism for the soil in the annular space 20 may need to be equal to or greater than that for the soils directly below the distal end 7 of the tube 3. When the wear ring is resting on the soil and 100% of the air flow is directed through the air relief slots 9, the excavating mechanism for the annular space 20 is optimized. When the wear ring 14 is lifted off the soil, and air can flow around the wear ring 14, the excavating mechanism for directly below the distal end 7 of the tube 3 is optimized.

The manifold 11 also defines air troughs 15 spaced around the outer perimeter of the manifold 11 between the nozzle port regions 16. The air troughs 15 are deep enough to allow sufficient air flow between the vacuum tube 3 and a sidewall 22 of the hole being excavated to prevent plugging. For a vacuum tube 3 roughly three inches in diameter, the air troughs 15 are preferably at least ¾of an inch deep measured radially from a point along the trough nearest to the central axis of the vacuum tube 3 to a point which is the same distance from the center of the vacuum tube 3 as an outermost tip of a nozzle port region 16 of the manifold 11.

Air allowed into the vacuum tube 3 assists in carrying particles of soil up the length of the assembly 1. The air relief slots 9 and air troughs 15 also minimize plugging of the vacuum tube 3 typically associated with use in soils having large clay content or other sticky conditions. The assembly 1 may operate to draw air, fluid, and debris radially through the air relief slots 9 (i.e., in a radial direction relative to the central axis A—A) even when the open distal end 7 of the tube 3 defined by the bottom edge of the wear ring 14 is completely sealed. The air relief slots 9 and the air troughs 15 ease removal of the assembly 1 from the excavated hole by preventing the assembly 1 from sucking to the bottom of the hole.

The process for potholing thus includes:

1) initially resting the wear ring 14 on the ground, thereby sealing off the distal end 7 of the tube 3;
2) applying vacuum to the proximal end of the vacuum tube 3 , thereby inducing air flow through the air relief slots 9 effectively creating two material excavating points as defined by the air relief slots 9;
3) applying fluid flow to nozzles 2 disposed in the nozzle ports 13 *a–c*, effectively cutting soils in the center of the vacuum tube 3 with the nozzle in port 13*a* and in the annular space 20 with the nozzles in ports 13*b* and 13*c;*
4) rotating the assembly 1 back and forth through approximately 180 degrees such that the nozzles in ports 13*b* and 13*c* completely cut the soil in the annular space 20 and air relief slots 9 completely excavate that cut soil and material; and
5) continuing to excavate the material while a hole is being formed. When the hole is deep enough so that the manifold 11 is in the hole, the air flow will be through the annular space 20 along the length of the vacuum tube 3 at some nominal rate, it will increase around the manifold 11 and nozzle ports due to the reduced cross sectional area through which it may flow;
6) occasionally lifting the assembly 1 such that the wear ring 14 is lifted off the soil so that soils directly below the distal end 7 of the tube are more aggressively excavated; and
7) operating by rotating the assembly 1, allowing the assembly 1 to rest on the soil effectively optimizing the excavation at the air relief slots 9 to remove material from the annular area 20, and occasionally lifting the assembly 1 effectively optimizing the excavation directly below the distal end 7 of the tube 3.

Figure 5:
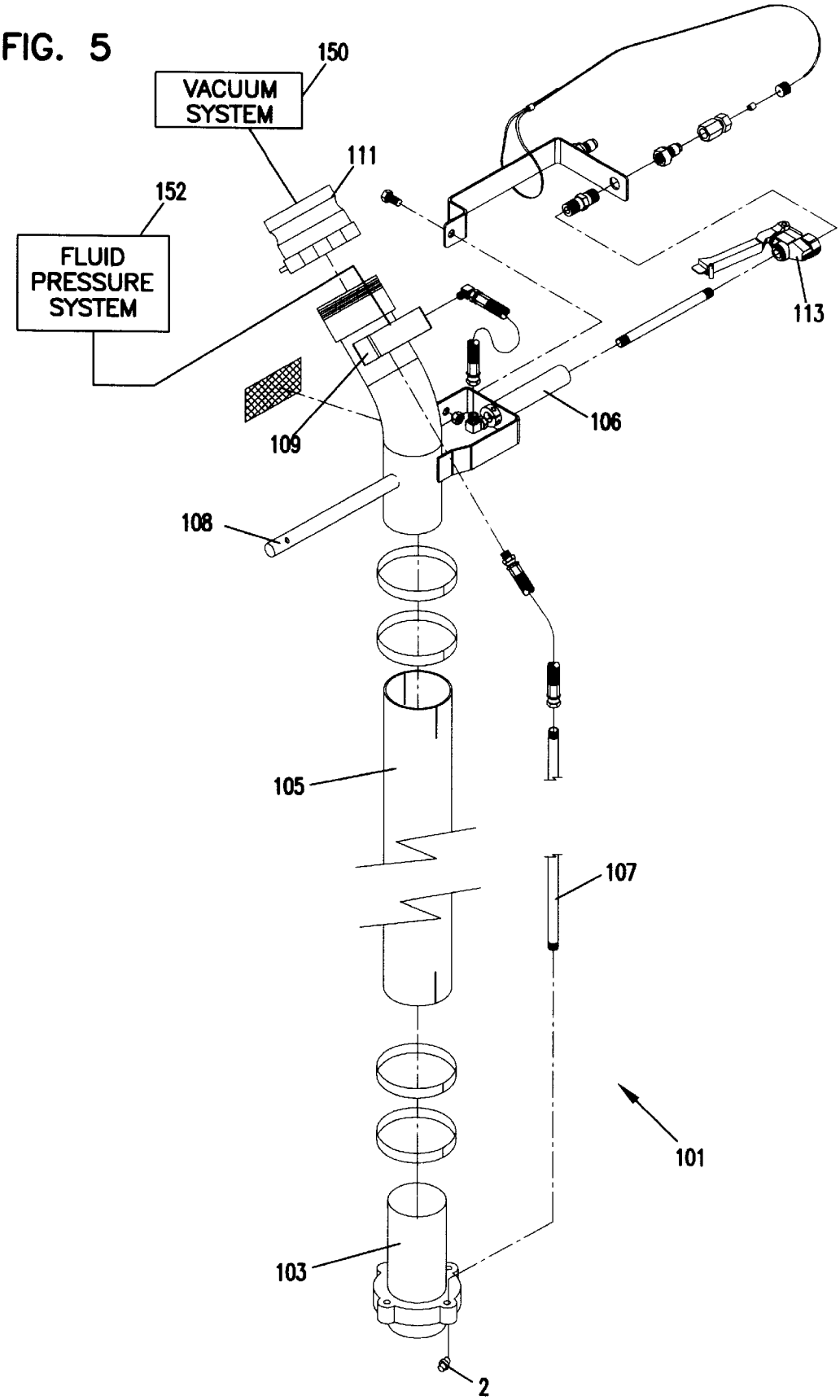
FIG. 5 shows an assembly drawing of an excavator wand system incorporating the present invention.
Figure 6:
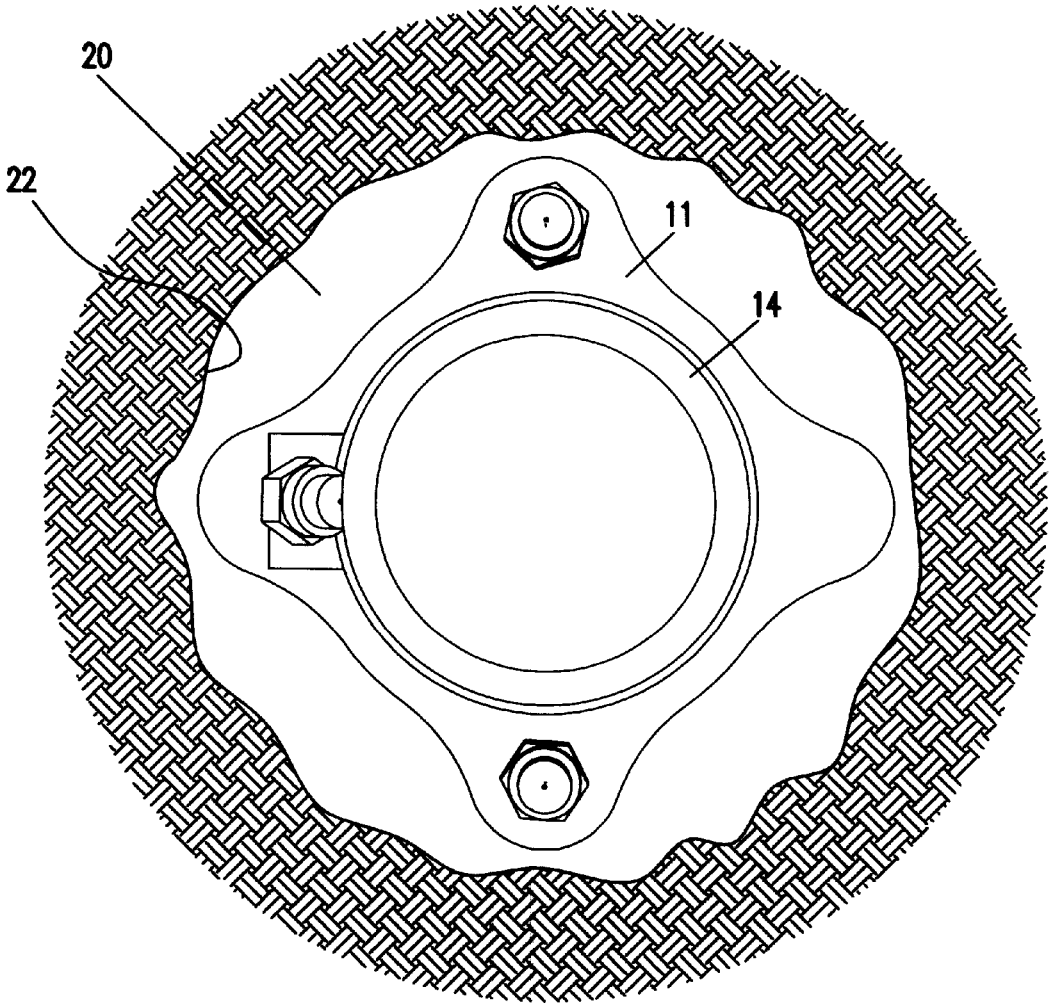
FIG. 6 shows an end view of the nozzle mount assembly of FIG. 1 disposed within a hole being excavated.

FIG. 5 shows an alternative embodiment of the present invention incorporated into an excavator wand 101. The excavator wand 101 includes a nozzle mount assembly 103 embodying the present invention, a vacuum shaft 105, a conduit or hose 107, an upper manifold 109, a vacuum coupling 111, operator handles 106 and 108 and a flow control valve 113. The vacuum coupling 111 couples the vacuum shaft 105 and nozzle mount assembly 103 to a vacuum system 150 for drawing out fluid mixed with soil cuttings and debris from the hole being excavated. In certain embodiments, the vacuum system 150 includes a vacuum and a reservoir for holding excavated material. The upper manifold 109 distributes pressurized fluid from a fluid pressure system 152 (e.g., a pump and a fluid reservoir from which the pump draws fluid) to a plurality of the conduits 107 (only one is shown). Preferably, one conduit is provided for each nozzle in the nozzle mount assembly 103. An operator may control the flow of fluid through the upper manifold by means of the flow control valve 113 incorporated into the operator handle 106. The excavator wand 101 may be used by rotating it generally 180° about its major axis as fluid jets produced by the nozzles in the nozzle mount assembly 103 cut away the soil. The vacuum tube of the nozzle mount assembly 103 and the vacuum shaft 105, powered by the vacuum system, remove soil and fluid from the hole.

The above specification, examples and data provide a description of the invention. Since many embodiments of the invention can be made without departing from the spirit and scope of the invention, the invention resides in the claims hereinafter appended.

What is claimed is:

1. An excavation wand comprising:

a vacuum tube having distal and proximal ends, the vacuum tube including a side wall defining a central evacuation passage, the distal end of the vacuum tube being open and in fluid communication with the central evacuation passage, and the side wall of the vacuum tube defining at least one air relief opening positioned adjacent the distal end of the vacuum tube;

at least one nozzle mounted near the distal end of the vacuum tube;

at least one conduit for providing pressurized fluid to the at least one nozzle; and wherein the nozzle is angled to direct fluid through the air relief opening.

2. An excavation wand comprising:

a vacuum tube having distal and proximal ends, the vacuum tube including a side wall defining a central evacuation passage, the distal end of the vacuum tube being open and in fluid communication with the central evacuation passage, and the side wall of the vacuum tube defining at least one air relief opening positioned adjacent the distal end of the vacuum tube;

at least one nozzle mounted near the distal end of the vacuum tube;

at least one conduit for providing pressurized fluid to the at least one nozzle; and a wear ring mounted at the distal end of the vacuum tube.

3. The excavation wand of claim 2, wherein the wear ring has a radial thickness that is greater than a wall thickness of the side wall of the vacuum tube.

4. The excavation wand of claim 2, wherein the wear ring defines a bottom edge of the at least one air relief opening.

5. The excavation wand of claim 4, wherein the at least one air relief opening comprises an elongated slot that extends upwardly from the wear ring.

6. An excavation wand comprising:

a vacuum tube having distal and proximal ends, the vacuum tube including a side wall defining a central evacuation passage, the distal end of the vacuum tube being open and in fluid communication with the central evacuation passage, and the side wall of the vacuum tube defining at least one air relief opening positioned adjacent the distal end of the vacuum tube;

at least one nozzle mounted near the distal end of the vacuum tube;

at least one conduit for providing pressurized fluid to the at least one nozzle; and wherein the at least one nozzle includes a first nozzle angled outwardly relative to the vacuum tube, and a second nozzle angled inwardly relative to the vacuum tube.

7. The excavation wand of claim 6, wherein the second nozzle is positioned to direct fluid inwardly through the air relief opening.

8. A soft excavation system comprising:

a vacuum system;

a fluid pressure system;

a vacuum tube to which the vacuum system applies negative pressure, the vacuum tube including a tube wall defining a central evacuation passage, the vacuum tube having a lowermost end that is at least partially open for allowing excavated material to be drawn into the central evacuation passage, and the tube wall defining at least one air relief opening located at least partially above the lowermost end for allowing excavated material to be drawn into the central evacuation passage;

at least one nozzle mounted near the lower end of the vacuum tube;

at least one conduit for conveying pressurized fluid from the fluid pressure system to the at least one nozzle;

a flow control valve for controlling the fluid flow provided from the fluid pressure system to the at least one nozzle; and wherein the at least one nozzle is angled to direct fluid through the air relief opening.

9. A soft excavation system comprising:

a vacuum system;

a fluid pressure system;

a vacuum tube to which the vacuum system applies negative pressure, the vacuum tube including a tube wall defining a central evacuation passage, the vacuum tube having a lowermost end that is at least partially open for allowing excavated material to be drawn into the central evacuation passage, and the tube wall defining at least one air relief opening located at least partially above the lowermost end for allowing excavated material to be drawn into the central evacuation passage;

at least one nozzle mounted near the lower end of the vacuum tube;

at least one conduit for conveying pressurized fluid from the fluid pressure system to the at least one nozzle;

a flow control valve for controlling the fluid flow provided from the fluid pressure system to the at least one nozzle; and a wear ring mounted at the lowermost end of the vacuum tube.

10. The excavation wand of claim 9, wherein the wear ring has a radial thickness that is greater than a wall thickness of the tube wall of the vacuum tube.

11. The excavation wand of claim 9, wherein the wear ring defines a bottom edge of the at least one air relief opening.

12. The excavation wand of claim 11, wherein the at least one air relief opening comprises an elongated slot that extends upwardly from the wear ring.

13. A soft excavation system comprising:

a vacuum system;

a fluid pressure system;

a vacuum tube to which the vacuum system applies negative pressure, the vacuum tube including a tube wall defining a central evacuation passage, the vacuum tube having a lowermost end that is at least partially open for allowing excavated material to be drawn into the central evacuation passage, and the tube wall defining at least one air relief opening located at least partially above the lowermost end for allowing excavated material to be drawn into the central evacuation passage;

at least one nozzle mounted near the lower end of the vacuum tube;

at least one conduit for conveying pressurized fluid from the fluid pressure system to the at least one nozzle;

a flow control valve for controlling the fluid flow provided from the fluid pressure system to the at least one nozzle; and wherein the at least one nozzle includes a first nozzle angled outwardly relative to the vacuum tube, and a second nozzle angled inwardly relative to the vacuum tube.

14. The excavation wand of claim 13, wherein the second nozzle is positioned to direct fluid inwardly through the air relief opening.

15. A nozzle manifold for use with a vacuum tube in soft excavation, the manifold configured to be disposed around the vacuum tube, the manifold comprising:

a manifold body defining a circular inner opening for receiving the vacuum tube;

the manifold body also defining a plurality of radially projecting nozzle port regions which define nozzle ports, the regions being spaced around an outer circumference of the manifold, at least one nozzle port being inwardly angled, and at least one nozzle port being outwardly angled; and the manifold body also defining air troughs spaced around the outer circumference of the manifold between the nozzle port regions.

16. The nozzle manifold according to claim 15, wherein two nozzle port regions define outwardly angled nozzle ports and one nozzle port region defines an inwardly angled nozzle port.

17. A nozzle mount assembly for use in soft excavation, the assembly comprising:

a vacuum tube having proximal and distal ends, the vacuum tube defining an air relief slot near its distal end;

a plurality of angled nozzle ports configured to receive nozzles, the nozzle ports being disposed around the circumference of the vacuum tube above the air relief slot; and wherein at least one of the angled nozzle ports is angled toward an interior of the vacuum tube and aligned with the air relief slot to direct a stream of fluid through the air relief slot.

18. The nozzle mount assembly according to claim 17 wherein the assembly comprises three angled nozzle ports.

19. The nozzle mount assembly according to claim 17 wherein at least one nozzle port is angled away from the vacuum tube.

20. A method of excavating with a soft excavator wand having a nozzle mount assembly according to claim 19, the method comprising:

placing nozzles in the nozzle ports of the nozzle mount assembly;

directing fluid through the nozzles in order to cut away soil at an excavation location, the nozzles in the outwardly angled nozzle ports cutting away soil to form an excavation hole larger in diameter than the diameter of a manifold of the nozzle mount assembly; and drawing air, fluid, and cuttings through the vacuum tube, the air being drawn from between a wall of the excavation hole and the vacuum tube, through air troughs of the manifold, and through the air relief slot of the vacuum tube.

21. A method of excavating a hole in a region of geologic material, the method comprising:

directing pressurized fluid at the geologic material to form the hole;

positioning an evacuation conduit in the hole; and removing excavated material from the hole by drawing the material into the evacuation conduit through an open area defined radially through a side wall of the evacuation conduit;

removing excavated material from the hole by drawing the material into the evacuation conduit through an open lower end of the evacuation conduit; and wherein the pressurized fluid is directed through the open area defined radially through the side wall of the evacuation conduit.

* * * * *